US007197148B2

(12) United States Patent
Nourse et al.

(10) Patent No.: US 7,197,148 B2
(45) Date of Patent: Mar. 27, 2007

(54) SYSTEM FOR CONTROLLING REMOTE SPEAKERS USING CENTRALIZED AMPLIFIERS, CENTRALIZED MONITORING AND MASTER/SLAVE COMMUNICATION PROTOCOL

(75) Inventors: James D. Nourse, Wernersville, PA (US); Keith R. Youndt, Pottstown, PA (US)

(73) Assignee: Hubbell Incorporated, Orange, CT (US)

( * ) Notice: Subject to any disclaimer, the term of this patent is extended or adjusted under 35 U.S.C. 154(b) by 501 days.

(21) Appl. No.: 10/236,926

(22) Filed: Sep. 9, 2002

(65) Prior Publication Data

US 2003/0063755 A1 Apr. 3, 2003

Related U.S. Application Data

(60) Provisional application No. 60/325,167, filed on Sep. 28, 2001.

(51) Int. Cl.
*H04R 27/00* (2006.01)

(52) U.S. Cl. ..... 381/82; 381/79

(58) Field of Classification Search ..... 381/82, 381/103, 105, 104, 95, 80, 77, 79
See application file for complete search history.

(56) References Cited

U.S. PATENT DOCUMENTS 1,550,724 A 8/1925 Hubbard ..... 179/81
3,989,908 A 11/1976 Budrys et al. ..... 179/175.1
4,550,400 A 10/1985 Henderson, Jr. et al. ..... 370/85
4,621,374 A 11/1986 Micic et al. ..... 455/603
4,683,591 A 7/1987 Dawson et al. ..... 381/85
4,862,159 A 8/1989 Marusa et al. ..... 340/825.24
4,953,218 A 8/1990 Hughes, Jr. ..... 381/82
5,054,076 A 10/1991 Lowell ..... 381/109
5,260,704 A 11/1993 Hustig et al. ..... 341/144
5,406,634 A * 4/1995 Anderson et al. ..... 381/82
5,481,478 A * 1/1996 Palmieri et al. ..... 709/208
5,561,412 A 10/1996 Novak et al. ..... 340/286.07
5,596,647 A 1/1997 Wakai et al. ..... 381/77
5,699,038 A 12/1997 Ulrich et al. ..... 340/286.07
5,838,223 A 11/1998 Gallant et al. ..... 340/286.07
5,887,067 A 3/1999 Costa et al. ..... 381/81
5,953,429 A 9/1999 Wakai et al. ..... 381/77
6,147,592 A 11/2000 Ulrich et al. ..... 340/286.07

* cited by examiner

*Primary Examiner*—Vivian Chin
*Assistant Examiner*—Con P. Tran
(74) *Attorney, Agent, or Firm*—Stacey J. Longanecker; Mark S. Bicks; Alfred N. Goodman

(57) ABSTRACT

An apparatus and method for providing a centralized speaker system that allows multiple speakers connected to a central amplifier speaker line to be monitored and controlled from a central location via a master/slave protocol. The centralized speaker system comprises a central station for selectively communicating at least one of a command and an information signal to a destination device. A tone generator is adapted to communicate an activation tone to the destination device. An amplifier, which is colocated with the central station, is adapted to amplify the signals to the destination device.

20 Claims, 7 Drawing Sheets

SYSTEM FOR CONTROLLING REMOTE SPEAKERS USING CENTRALIZED AMPLIFIERS, CENTRALIZED MONITORING AND MASTER/SLAVE COMMUNICATION PROTOCOL

CROSS REFERENCES TO RELATED APPLICATIONS

This application claims benefit under 35 U.S.C. § 119(e) from U.S. Provisional Patent Application Ser. No. 60/325,167 filed on Sep. 28, 2001, the entire contents of said application being expressly incorporated herein by reference.

FIELD OF THE INVENTION

The invention relates to a method and apparatus for controlling audio speakers and, more particularly, to a method and apparatus for controlling a plurality of remote audio speakers from a central station via centralized amplifiers.

BACKGROUND OF THE INVENTION

Public address systems have been configured traditionally with multiple speakers that are connected together and driven with a common signal, or combined together as multiple networks or zones with a common signal per zone. The common signal originates from one or more sources of audio signal selected for transmission to all speakers, or to all speakers in a zone.

Typically, a public address system is configured as a system in which the amplifiers are colocated with the speakers, that is, the amplifiers are located in the same enclosure as the speakers. A user can adjust the volume of the speakers at the amplifier. The design is simple. A signal from the same source is transmitted to each amplifier. If the amplifiers are distributed throughout the building, different listeners can adjust the volume of the speakers to suit the environment they are in. For example, a listener in a noisy machine shop can adjust the volume to a higher level than a listener receiving the same signal in an office.

U.S. Pat. No. 4,922,536 discloses frequency division (FDM) and/or time division multiplexing (TDM) to digitally transmit audio signals from multiple microphones to a control booth, and to digitally transmit audio signals from the control booth to speakers. At each end of the digital transmission, the digital signals are converted to analog signals for processing. The control booth provides the control for all of the speakers. In another example, use of a microprocessor in a computing system to control routing of audio signals on a computer bus is shown in U.S. Pat. No. 4,862,159. In both of these audio systems, the speakers are dumb devices, that is, there is no digital audio processing at the speakers themselves.

Another example of a distributed speaker system is disclosed in U.K. Patent Application GB 2,123,193A which discloses a speaker system having a master station and remote speakers. Each of the remote speakers has a unique address, and the volume of each speaker can be individually adjusted. However, each speaker requires a respective amplifier that is integrated with the speaker. The amplifier also acts as a switching device to turn the speakers on and off Thus, it is desirable to provide more flexibility in a speaker system network by using separate audio signals at each speaker in the network. For example, an operator at a central point may wish to transmit a message to only selected speakers in a network, or in multiple networks or zones, rather than to all speakers in a network or zone. Further, it is desirable to maintain amplifiers for each of the speakers in a speaker system network in a central location. Thus, the remote units are less expensive and simpler to maintain.

It is also desirable to provide separate volume control for each speaker, and to selectively broadcast the audio signal to selected speakers in the network system. For example, it is desirable for a public address system to remotely adjust the volume at selected speakers and selectively broadcast to the speakers.

SUMMARY OF THE INVENTION

In accordance with the present invention, a speaker system is provided having distributed speakers and amplifiers and centralized speaker monitoring and command control.

In accordance with an aspect of the present invention, an intelligent speaker unit is provided for use in the speaker system. In such a system, remote speakers can be selected. The volume for the selected speakers can be adjusted for its corresponding environment, and all of these tasks can be accomplished from a master station. In addition, the volume of the remote speakers can be adjusted locally or remotely using a field programmable device. A central amplifier is colocated with the master station and can serve a plurality of speakers.

In accordance with another aspect of the present invention, power is provided to the remote speaker units using an inaudible signal that is controlled from the master station via a tone generator.

In accordance with still another aspect of the present invention, the remote speakers can be addressed individually or as part of a group. Thus, each remote speaker and each group are capable of receiving unique content specific, respectively, to the individual remote speaker address and group address.

BRIEF DESCRIPTION OF THE DRAWINGS

The details of the present invention can be readily understood by considering the following detailed description in conjunction with the accompanying drawings, in which.

To facilitate understanding, identical reference numerals have been used to designate identical elements that are common to the figures.

DETAILED DESCRIPTION OF THE PREFERRED EMBODIMENTS

Although the present invention is described for use in an industrial environment, the present invention can also be used in other types of environments. For example, the present invention can also find application in a residential environment and a commercial environment. One such commercial environment can be a department store. For instance, sales announcements can be targeted to specific departments or floors.It will be appreciated by those skilled in the art that, although the present invention is described in the context of a public address system, the invention can be modified to be used in speaker systems in general.

Figure 1:
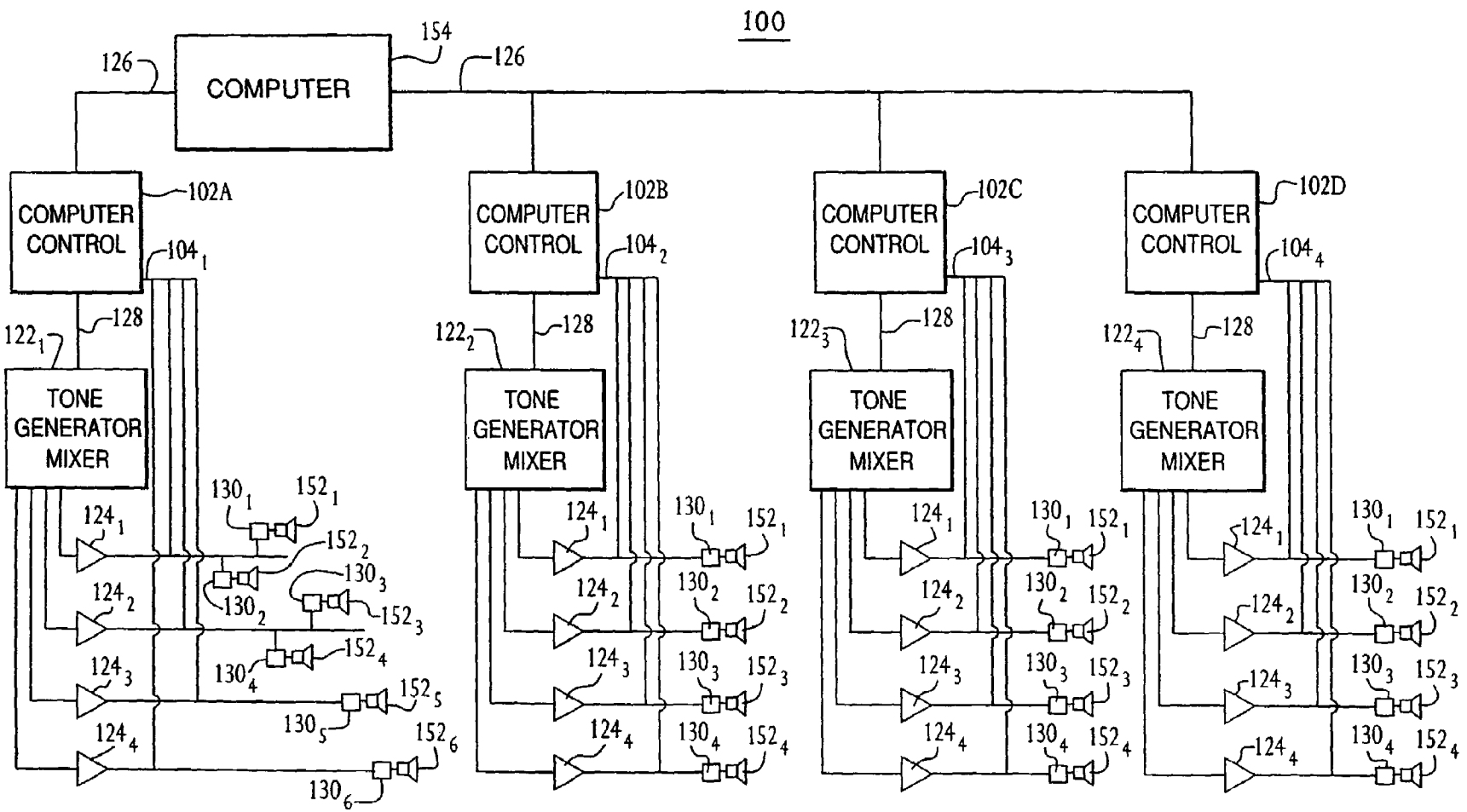
FIG. 1 is a block diagram of a public address (PA) speaker system constructed in accordance with an embodiment of the present invention.

FIG. 1 depicts a public address speaker system 100 in accordance with a first embodiment of the present invention. In the illustrated embodiment, four master control units 102A, 102B, 102C and 102D are used to monitor and control respective sets of speakers connected thereto. By way of an example, connected to master control unit 102A are a Generator/Mixer $\mathbf{122}_1$, a first amplifier $\mathbf{124}_1$, second amplifier $\mathbf{124}_2$, third amplifier $\mathbf{124}_3$ and fourth amplifier $\mathbf{124}_4$ hereinafter referred to plurality of amplifiers 124), a first RS-485 bus 126, a second RS-485 bus 128, a plurality of remote units 130 depicted as a first remote unit $\mathbf{130}_1$, a second remote unit $\mathbf{130}_2$, a third remote unit $\mathbf{130}_3$, a fourth remote unit $\mathbf{130}_4$, a fifth remote unit $\mathbf{130}_5$ and a sixth remote unit $\mathbf{130}_6$, and a plurality of speakers 152 depicted as a first speaker $\mathbf{152}_1$, a second speaker $\mathbf{152}_2$, a third speaker $\mathbf{152}_3$ and a fourth speaker $\mathbf{152}_4$, a fifth speaker $\mathbf{152}_5$ and sixth speaker $\mathbf{152}_6$. The other master control units have similar configurations, that is, they are each connected to a tone generator/mixer 122, a plurality of amplifiers 124, remote units and corresponding speakers. Each master control unit 102 is connected to a computer 154. The generator mixer 122 preferably supplies a 35 Hz or similar tone that is not audible as the power signal for the speakers 152.

The operation of the speaker system 100 will now be described in general. Speaker system 100 provides the ability to address each of the plurality of speakers 152 individually or as a group. Depending on how the master control units 102 and remote units 130 are configured, a plurality of speakers can be organized into groups allowing the speakers to receive the same program material where the program material can be music and/or speech, for example. Alternatively, the plurality of speakers can be configured wherein each speaker is separate from the other speakers and must be addressed individually. Although each speaker 152 is connected to a particular master control unit 102, speakers connected to respective ones of the master control units (e.g., master control unit 102A and 102D) can be assigned to the same group via the computer 154.

Each of the plurality of speakers 152 preferably has a unique 16-bit address. Each of the plurality of speakers 152 can further be assigned up to four group identifiers (IDs), allowing as many as 255 possible group assignments for the plurality of speakers 152 for each of the four groups. The group identifier allows specific speakers to be assigned to a group and receive the same program signal. For example, with regard to the speakers connected to master control unit 102A, first speaker $\mathbf{152}_1$ and second speaker $\mathbf{152}_2$ can be assigned to group A. Third speaker $\mathbf{152}_3$ and fourth speaker $\mathbf{152}_4$ can be assigned to group B. Fifth speaker $\mathbf{152}_5$ can be assigned to group C, and sixth speaker $\mathbf{152}_6$ can be assigned to group D. This allows each group to be assigned to a specific area and receive addressed program material with respect to other groups, if desired. As a further example, first speaker 152, can be assigned to more than one group.

The master control unit 102 is preferably assigned a 4-bit address, allowing up to 16 master control units 102 to be used in the speaker system 100. In a second embodiment of the invention, the computer 154 can be connected to the master control unit 102 via the first RS-485 bus 126. In this manner, up to 16 master controls units 102 can be controlled individually and/or simultaneously via the computer 154 using the master control unit 102 addresses.

The master control unit 102 is also connected to the 35 Hz generator/mixer 122 via the second RS-485 bus 128. The RS-485 interface standard, which is hereby incorporated by reference in its entirety, is used in multipoint applications where at least one master control unit 102 and/or computer 154 controls many different devices. Although the present invention is depicted as using the RS-485 interface, the invention may be modified to include other types of interfaces and still fall within the scope of the present invention. In accordance with a preffered embodiment of the present invention, 35 Hz generator/mixer 122 can be connected to as many as four amplifiers. In FIG. 1, the 35 Hz generator/mixer 122 is, illustratively, connected to first amplifier $\mathbf{124}_1$, second amplifier $\mathbf{124}_2$, third amplifier $\mathbf{124}_3$and fourth amplifier $\mathbf{124}_4$. Each amplifier 124 can be connected to as many as thirty remote units 130, and each remote unit controls a respective speaker 152. Specifically, with regard to master control unit 102A, first amplifier $\mathbf{124}_1$ is connected to first remote unit $\mathbf{130}_1$ and to second remote unit $\mathbf{130}_2$. First remote unit $\mathbf{130}_1$ is connected to first speaker $\mathbf{152}_1$. Second remote unit $\mathbf{130}_2$ is connected to second speaker $\mathbf{152}_2$. Second amplifier $\mathbf{124}_2$ is connected to third remote unit $\mathbf{130}_3$ and fourth remote unit $\mathbf{130}_4$. Third remote unit $\mathbf{130}_3$ is connected to third speaker $\mathbf{152}_3$, and fourth remote unit $\mathbf{130}_4$ is connected to fourth speaker $\mathbf{152}_4$. Third amplifier $\mathbf{124}_3$ is connected to fifth remote unit $\mathbf{130}_5$ which is in turn connected to fifth speaker $\mathbf{152}_5$. Fourth amplifier $\mathbf{124}_4$ is connected to sixth remote unit $\mathbf{130}_6$ which is in turn connected to sixth speaker $\mathbf{152}_6$.

Referring to the operation of speaker system 100, an Enter Command Mode command is communicated to a particular master control unit 102 via the computer 154 and/or a master console with a memory and input devices (not shown). This command causes the master control unit 102 to enable a corresponding 35 Hz generator/mixer 122 to generate a 35 Hz power signal. As stated previously, the 35 Hz signal is inaudible and powers the corresponding remote units 130. Specifically, the 35 Hz signal powers each of the remote units 130 via the colocated amplifier 124. The remote units 130 each monitor the incoming message from the master unit 102 to determine whether it is being addressed either as an individual unit or as part of a group. Remote units 130 that are not being addressed power themselves off. If any of the remote units 130 are being addressed, the units remain powered on and communicate an acknowledgement to the master control unit 102.

More particularly, the master control unit 102 communicates a command, along with data, wherein the two signal components comprise a message. The data portion of the message can comprise an address field, group identifier (ID) field, speaker status field and/or a tap setting field, as described below. The commands can comprise a command such as, but not limited to, an Idle/All-Page, Group Page, Speaker Page, Speaker Poll, Speaker Group A configure, Speaker Group B configure, Speaker Group C configure, Speaker Group D configure, Idle/All Page Tap Configure, Retrieve Configuration, Acknowledge Response, Config Response 1, and Config Response 2.

The tap setting is a predetermined audio setting and can comprise the following settings: off, low, mid, high and full. Each audio setting has a specific volume setting. The present invention can be modified by those skilled in the art to utilize numerical or other incremental or graduated settings to achieve specific volume levels and still fall within the scope of the present invention.

The Idle/All Page Tap Configure command is communicated to all remote units 130 and resets all tap settings to a default value. The Group Page command is communicated to remote units 130 that are assigned to a selected group. Rather than determining whether the command is addressed to the remote unit's 130 individual address, the remote unit 130 determines whether it is assigned to the group that is contained in the incoming message.

The Speaker Page command is communicated from a master control unit 102 to a specific speaker. All of the remote units 130 compare the address of the incoming message to their own address to determine whether the message is addressed to them. If the message is addressed to them, the unit remains powered on, executes the command, and/or communicate a response message to the master control unit 102.

Speaker system 100 also has an audio current monitoring system that monitors the current between the remote units 130 and the speakers 152. A conventional current transformer is preferably provided in the tap control and speaker fault sense circuit 142 (FIG. 3) to detect a drop in current between each of the speakers 152 and their corresponding remote units 130. Additionally, the remote units 130 are polled via the Speaker Poll command. Specifically, each remote unit 130 is requested by the master control unit 102 to provide its status. If a current drop or no current is detected between the remote unit 130 and respective speaker 152, the remote unit 130 communicates this information to the master control unit 102. A repairman can then be dispatched to the identified remote unit 130 and/or speaker 152 and make the necessary repairs. If no faults are detected by the remote unit 130, a positive indication is communicated to the master control unit 102.

As stated previously, remote units 130 and their respective speakers 152 can be assigned, for example, to groups A, B, C and/or D. The Speaker Group A configure, Speaker Group B configure, Speaker Group C configure, and Speaker Group D configure commands are used to configure the remote unit 130. The Idle/All Page Tap configure command is communicated from the master station 102 to the remote units 130. The command establishes the default value for the Idle/All page command.

The Retrieve configuration command is communicated from the master station 102 to the remote stations 130 to determine the configuration of the remote settings. The remote units 130 respond with a Config Response 1 acknowledgement containing their address, the ID of the group, if any, that they belong to, and their status. The remote units can also respond with a Config Response 2 response containing their idle tap setting, the ID of the group, if any, that they belong to and their present tap setting.

Figure 2:
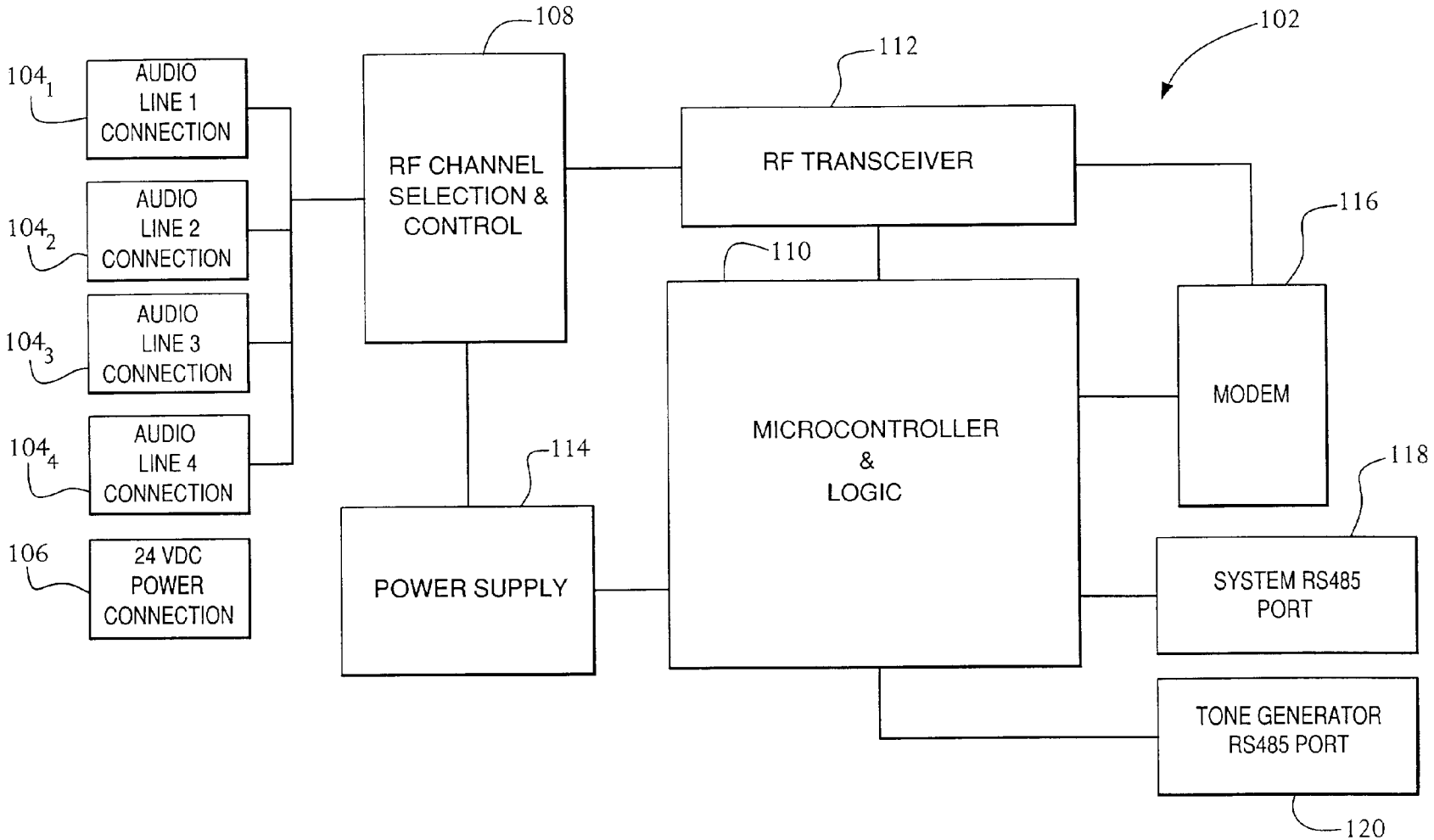
FIG. 2 is a block diagram of a master unit for the speaker system of FIG. 1 that is constructed in accordance with an embodiment of the present invention.

FIG. 2 depicts components of the master control unit 102 for the speaker system in accordance with an embodiment of the present invention. Specifically, the master control unit 102 comprises a master microcontroller 110 which is connected to an RF transceiver 112, a modem 116 (e.g., a 9600 baud RF modem), a power supply 114, a system RS485 port 118, and a tone generator RS485 port 120. The modem 116 is also connected to the RF transceiver 112 which is connected to the RF channel & control circuit 108. A plurality of audio lines 104 illustratively depicted as $\mathbf{104}_1$, $\mathbf{104}_2$, $\mathbf{104}_3$ and 1044 are connected to the RF channel selection & control circuit 108. The power supply 114 is preferably connected to a 24V DC power connection 106.

The microcontroller 110 controls the speakers and associated devices connected thereto, as well as serving as an interface between the computer 154 and the remote units 130. The computer 154 and microcontroller 110 preferably communicate via the system RS485 port 118.

As stated previously, each master control unit 102 has a unique 4-bit address that the computer 154 can use to address it. Upon receiving an indication from computer 154 that a command will be sent to a speaker, the microcontroller 110 of the addressed master control unit(s) enables its 35 Hz generator/mixer 122. Specifically, the master microcontroller 110 communicates an activation signal to the 35 Hz generator/mixer 122 via the tone generator RS485 port 120. The 35 Hz generator/mixer 122, in turn, communicates a 35 Hz signal to the amplifier 124 which powers the remote unit(s) 130 connected to the speaker being addressed for the time period that the 35 Hz signal is being communicated.

The microcontroller 110 then communicates the command received from the computer 154 to the remote unit(s) 130. The command is communicated to the modem 116 in a digital format. The modem 116 converts the received signal to an analog signal. The analog signal is then communicated to the RF transceiver which modulates the analog signal to an appropriate frequency.

The modulated analog signal is then communicated to the RF channel selection & control circuit 108. When the microcontroller 110 communicates a command to a remote unit 130, the microcontroller 110 preferably operates without data concerning the audio line 104 to which the remote unit is connected. Therefore, all of the remote units 130 are preferably powered on and the command is communicated on all of the audio lines 104. Each of the remote units then determines whether the received command is addressed to it.

Figure 3:
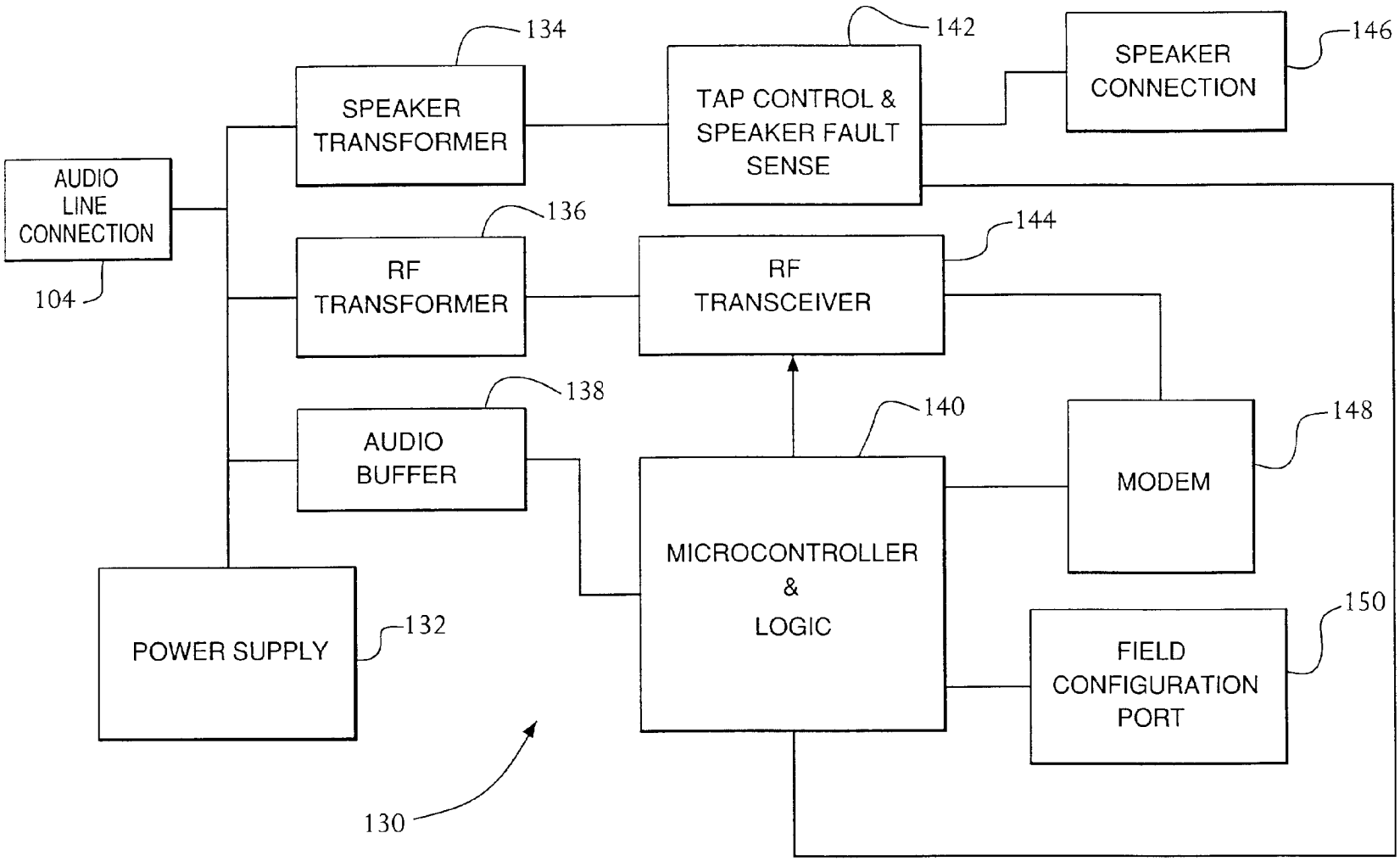
FIG. 3 is a block diagram of a remote unit for the speaker system of FIG. 1 that is constructed in accordance with an embodiment of the present invention.

FIG. 3 is a block diagram of a remote unit 130 for the speaker system of FIG. 1 that is constructed in accordance with an embodiment of the present invention. The remote unit 130 preferably comprises a microcontroller 140 connected to a field configuration port 150, a modem 148, a transceiver 144, an audio buffer 138, a tap control & speaker fault sense circuit 142, and a power supply 132. The power supply is also connected to the audio buffer 138, an RF transformer 136 and speaker transformer 134.

The audio line connection 104 interfaces with the speaker transformer 134, the RF transformer 136 and audio buffer 138. When a signal is received at the remote unit 130, the signal is routed and processed according to its frequency. For example, when a 35 Hz signal is received at the remote unit 130 via the audio line 104, the 35 Hz signal is routed to the audio buffer 138 which then communicates the signal to the microcontroller 140. The remote unit 130 is then activated to receive commands from the master control unit 102.

It is conventional to use human speech to power up the remote unit 130; however, human speech fluctuates and can cause a circuit board to repeatedly power on and off. By having a 35 Hz signal, that is, a continuous inaudible signal as a power signal, no interference will occur between an audible page and the 35 Hz signal.

The received signal can also be a command from a corresponding master control unit 102. The command is routed to the RF transformer 136 and communicated to the RF transceiver 144 where it is then demodulated and communicated via the RF transceiver 144 to the modem 148 (e.g., a 9600 baud RF modem) for conversion to a digital signal. The microcontroller 140 receives the digital signal from the modem 148 and executes the command.

For example, if the command required that a tap setting be made, the microcontroller 140 communicates the settings to the tap control & speaker fault sense circuit 142 which adjusts relays (not shown) that changes the transformer settings on the speaker transformer 134. The tap control & speaker fault sense circuit 142 also monitors the current between the speaker 152 and the remote unit 130 (e.g., via a current transformer (not shown)). If a drop in current or no current is detected, the remote unit 130 informs the master control station 102 when a command for its status is received.

The field configuration port 150 allows on-site programming of the remote unit 130. When the remote unit is first installed, its address needs to be stored on the remote unit 130 so that it can respond to messages addressed to it from the master control unit 102. Any type of computer-related device can be used to program the remote unit 130.

Figure 4:
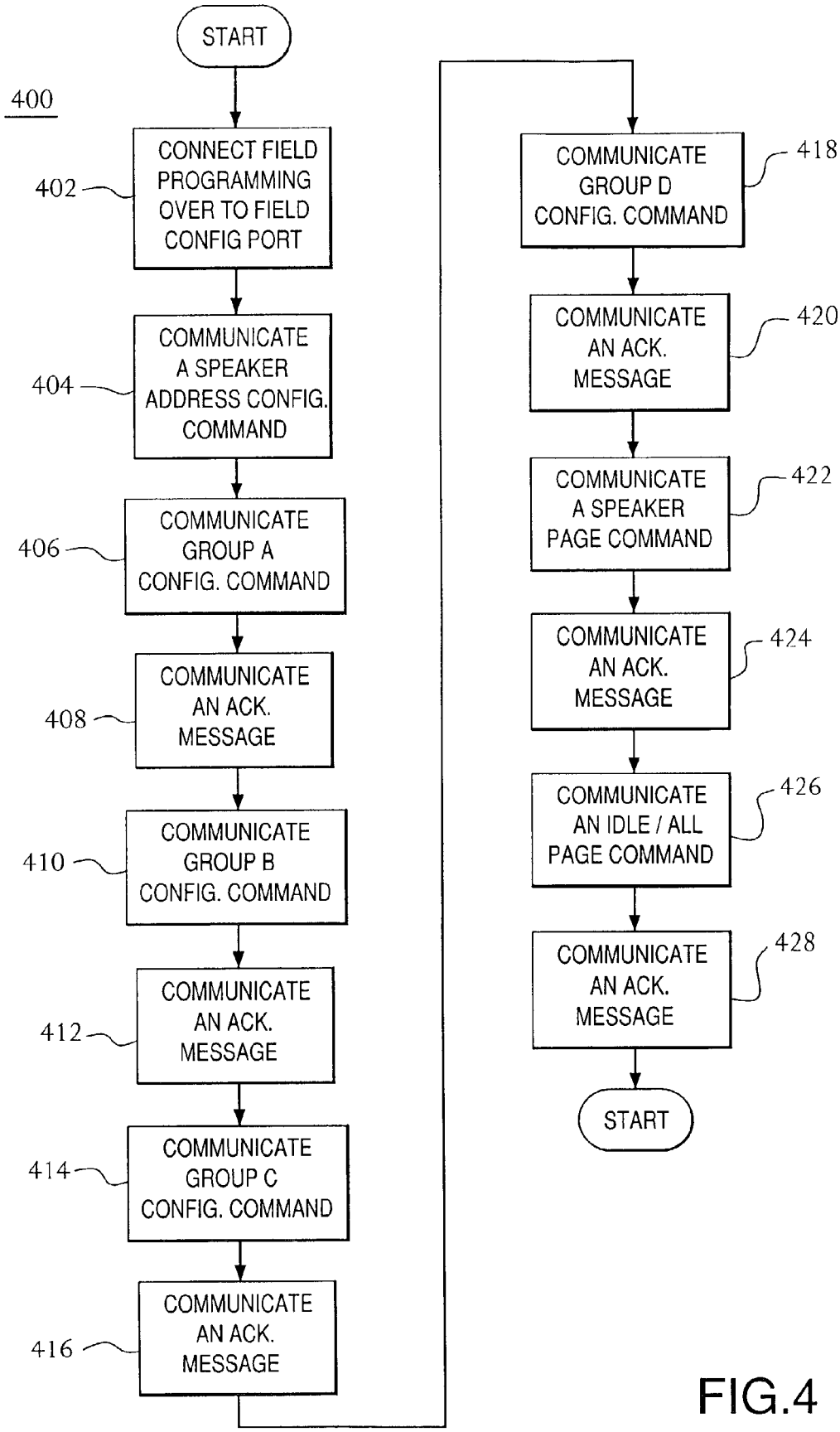
FIG. 4 is a flow chart depicting a sequence of operations for configuring a speaker in accordance with an embodiment of the present invention.

FIG. 4 is a flow chart depicting a sequence of operations for configuring a speaker in accordance with an embodiment of the present invention. The method 400 proceeds to step 402 where a field programming device (not shown) is connected to the field configuration port 150 (e.g., serial port). The field programming device can be a computer, processor, terminal and the like.

At step 404, the field programming device communicates a Speaker Address Configure command which allows the field programming device to assign a 16-bit address to the remote unit 130.

At step 406, the field programming device communicates the Speaker Group A configure command to the remote unit 130. The remote unit's address, Group (ID), and tap settings are provided as inputs, for example, to the microcontroller 140 and associated memory. These settings apply to Group A. Additionally, each group can comprise subgroups numbered from 1 to 255 (i.e., each speaker can belong to any of the 255 subgroups).

At step 408, the remote unit 130 communicates an acknowledgement message to the field programming device. This indicates that the remote unit accepted the inputted information and serves as a confirmation.

At step 410, the field programming device communicates the Speaker Group B configure command to the remote unit 130. The remote unit's address, Group ID, and tap settings are provided as inputs to the microcontroller 140. These settings apply to Group B. Additionally, each group can be numbered from 1 to 255, allowing 255 subgroups to be assigned to Group B.

At step 412, the remote unit 130 communicates an acknowledgement message to the field programming device. This indicates that the remote unit 130 accepted the Group B configuration information and serves as a confirmation.

At step 414, the field programming device communicates the Speaker Group C configure command to the remote unit 130. The remote unit's address, Group ID, and tap settings are provided as inputs to the microcontroller 140. These settings apply to Group C. Additionally, each group can be numbered from 1 to 255 allowing 255 subgroups to be assigned to Group C.

At step 416, the remote unit 130 communicates an acknowledgement message to the field programming device. This indicates that the remote unit accepted the Group C configuration information and serves as a confirmation.

At step 418, the field programming device communicates the Speaker Group D configure command to the remote unit 130. The remote unit's address, Group ID, and tap settings are provided as inputs to the microcontroller 140. These settings apply to Group D. Additionally, each group can be numbered from 1 to 255, allowing 255 subgroups to be assigned to Group D.

At step 420, the remote unit 130 communicates an acknowledgement message to the field programming device. This indicates that the remote unit accepted the Group D configuration information and serves as a confirmation.

Although the method 400 depicts all four groups being inputted to a speaker, it is possible to practice the invention with no groups, or more or less than the use of four groups.

At step 422, the field programming device communicates a Speaker Page configure command to the remote unit 130. The address of the remote unit(s) 130 is inputted, along with tap settings. The remote unit(s) 130 store the received tap settings which are the volume levels each corresponding speaker will output when it receives a page to its individual address and not to its group address. As discussed above, each group has its own tap settings.

At step 424, the remote unit 130 communicates an acknowledgement to the field programming device indicting that the inputted information is accepted.

At step 426, the field programming device communicates an Idle/All Page configure command to the remote unit 130. Tap settings and the remote unit's address are also inputted. The tap setting inputted is the default tap setting. All of the speakers are preferably set at the same default volume.

At step 428, the remote unit 130 communicates an acknowledgement to the field programming device indicating that the settings inputted were accepted.

Computer 154 stores tables of which speaker is connected to which master control unit 102 and the settings of groups and individual speakers 152. A user options the speaker system 100 via the computer 154 and/or the field programming device.

Figure 5:
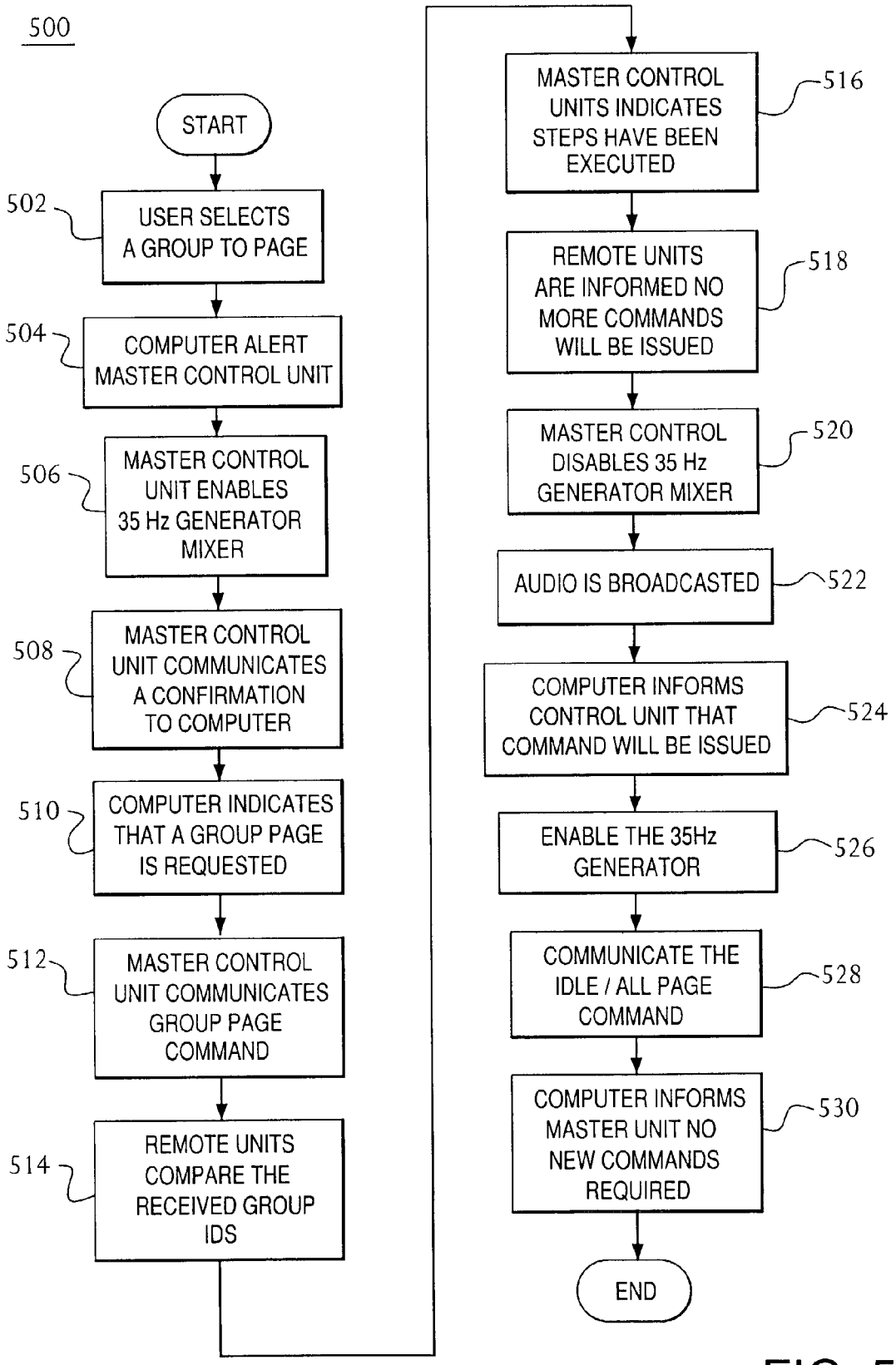
FIG. 5 is a flow chart depicting a sequence of operations for initiating a group page in accordance with an embodiment of the present invention.

FIG. 5 is a flow chart depicting a sequence of operations for initiating a group page in accordance with an embodiment of the present invention. The method 500 is initiated at step 502 where a user selects a particular group to page from a master control unit.

At step 504, the computer 154 alerts the master control unit(s) 102 corresponding to the speakers in the selected group that a command will soon be issued. In response to this indication, each master control unit 102, at step 506, enables its corresponding 35 Hz generator/mixer 122, which communicates a power signal to all of the remote units 130 associated with that master control unit to provide power to the remote units 130.

At step 508, each master control unit 102 associated with the selected group communicates to the computer 154 a confirmation that the remote units are powered.

At step 510, the computer 154 communicates to the master control unit(s) 102 that a group page has been requested, along with the group Id.

At step 512, the master control unit(s) 102 communicate a Group Page command to the remote units 130, along with the group IDs. Each speaker loop receives the command.

At step 514, the remote units 130 compare the received group IDs to the group IDs that they were assigned. If the group IDs do not match, the remote units set their tap settings to off. However, if the group IDs do match, then the remote units set their tap settings to the assigned group setting.

At step 516, the master control unit(s) 102 communicate to the computer 154 that the Group Page command has been configured.

At step 518, the master control unit(s) 102 communicate to their corresponding remote units that there are no more commands to be carried out.

At step 520, the master control unit(s) 102 disable their corresponding 35 Hz generator/mixers 122. Specifically, an End Command Mode command is communicated to the 35 Hz generator/mixers 122. The master control unit(s) 102 also communicate a confirmation message to the computer 154 that the 35 Hz generator/mixer is no longer powering the remote units 130.

At step 522, an audio signal is broadcast by the speaker system 100 via respective speakers 152 in the selected group. The remote unit(s) 130 and respective speakers 152 that were not part of the group page previously sent, set their tap settings to zero. Therefore, audio will not be broadcast from those speakers but rather only from the speakers that were identified as being in the selected group.

At step 524, the computer 154 communicates to the master control unit(s) 102 that a command will be issued. In response to this communication, the master control unit(s) 102, at step 526, enable their corresponding 35 Hz generator/mixers 122 to power the remote units 130 and place the remote units 130 into the idle/default state. The master control unit(s) 102 communicate to the computer 154 that their remote units 130 are powered.

At optional step 528, the master control unit(s) 102 can communicate the Idle/All Page command to the remote units 130 and set the tap settings for the remote units to a default setting. As indicated at step 528, the paging type can go from a group page to an idle/all page without having to turn the 35 Hz generator/mixer off and then back on again. That means that the remote unit(s) 130 that are in the selected group remain powered while the remote unit(s) 130 that are not in the selected group become powered at step 526.

At step 530, the computer 154 communicates to the master control unit(s) 102 that there are no more commands expected. In response to the communication, the master control unit(s) 102 disable their corresponding 35 Hz generator/mixers 122 and send a confirmation to the computer 154.

Figure 6:
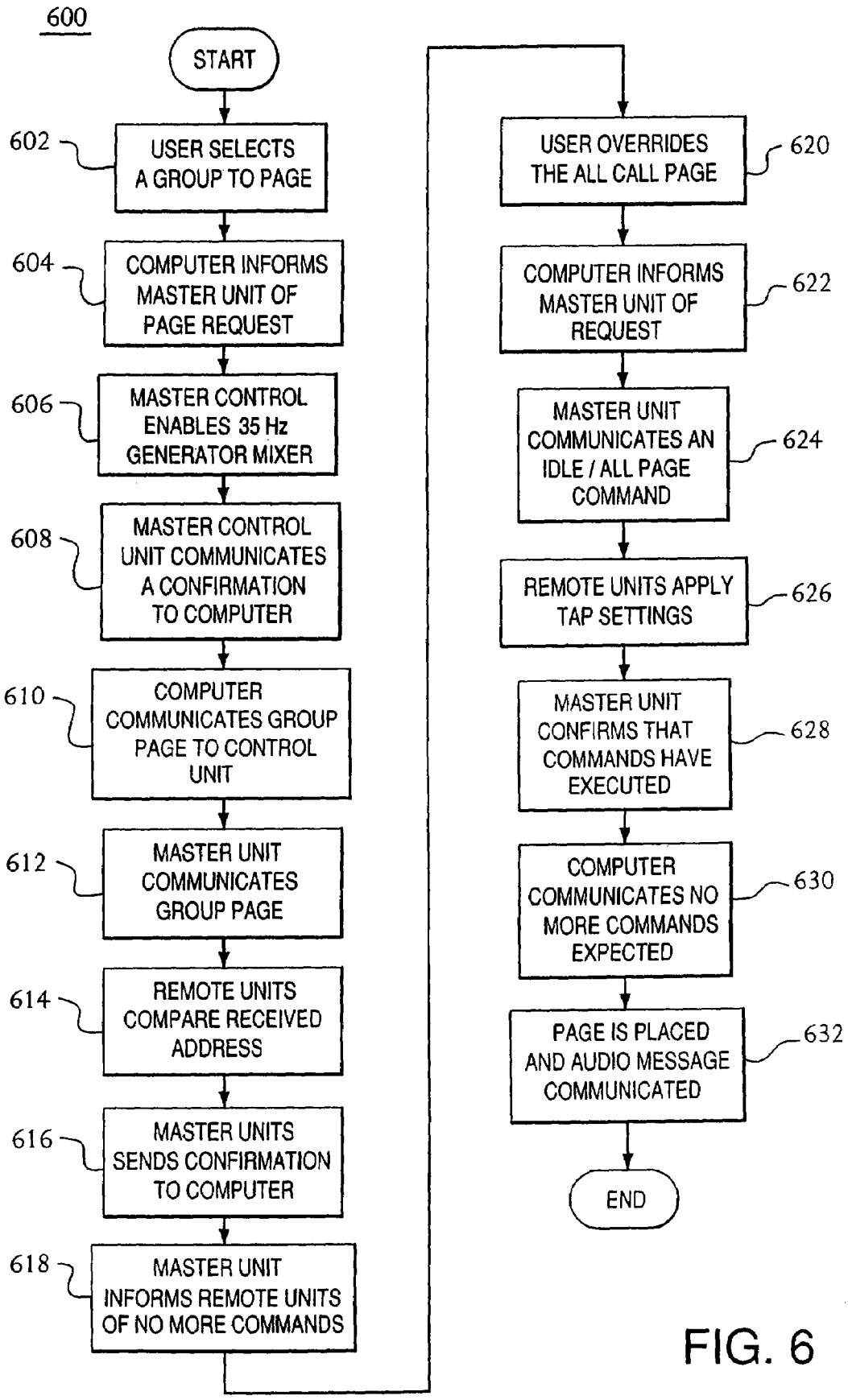
FIG. 6 is a flow chart depicting a sequence of operations for overriding a group page with an all call page in accordance with an embodiment of the present invention.

FIG. 6 is a flow chart depicting a sequence of operations for overriding a group page with an all-call page in accordance with an embodiment of the present invention. The method 600 is initiated at step 602 where a user selects particular group(s) to page from a master control unit(s) 102 from the computer 154.

At step 604, the computer 154 alerts the master control unit(s) 102 corresponding to the speakers in the selected groups that a command will soon be issued. In response to this indication, the master control unit(s) 102, at step 606, enable their corresponding 35 Hz generator/mixers which provide s a power signal that powers the remote units 130 associated with the selected groups.

At step 608, the master control unit(s) 102 associated with the selected groups communicate to the computer 154 a confirmation message that the remote units 130 are powered.

At step 610, the computer 154 communicates to the master control unit(s) 102 that a group page has been requested, along with the group ID.

At step 612, the master control unit(s) 102 communicate a Group Page command to their corresponding remote units 130, along with the group IDs. Each speaker loop receives the command.

At step 614, the remote units 130 compare the received group IDs to the group IDs that they were assigned. If the group IDs do not match, the remote units 130 set their tap settings to off. However, if the group ID's do match, then the remote units 130 set their tap settings to the assigned group setting. The method 600 then proceeds to step 616.

At step 616, the master control unit(s) 102 communicate to the computer 154 that the Group Page command has been configured.

At step 618, the master control unit(s) 102 communicate to their corresponding remote units that there are no more commands to be carried out.

At step 620, a user over-rides the group page with an emergency All Call page via the master console. In response to the emergency All Call page, the computer 154, at step 622, communicates to the master control unit(s) 102 that an All Call page has been requested by a user.

At step 624, the master control unit(s) 102 communicate an Idle/All Page command to their respective remote units 130. Upon receiving the Idle/All Page command, the remote units 130 apply their default tap settings at step 626.

At step 628, the master control unit(s) 102 communicate to the computer 154 that the All Page command has been executed by the remote units 130.

At step 630, the computer 154 communicates to the master control unit 102 that no more commands are expected. In response, the master control unit(s) 102 disable their 35 Hz generator/mixers 122 and communicate the disablement of the generator/mixers 122 to the computer 154.

At step 632, the page is placed and the announcement goes to all the speakers 152.

Figure 7:
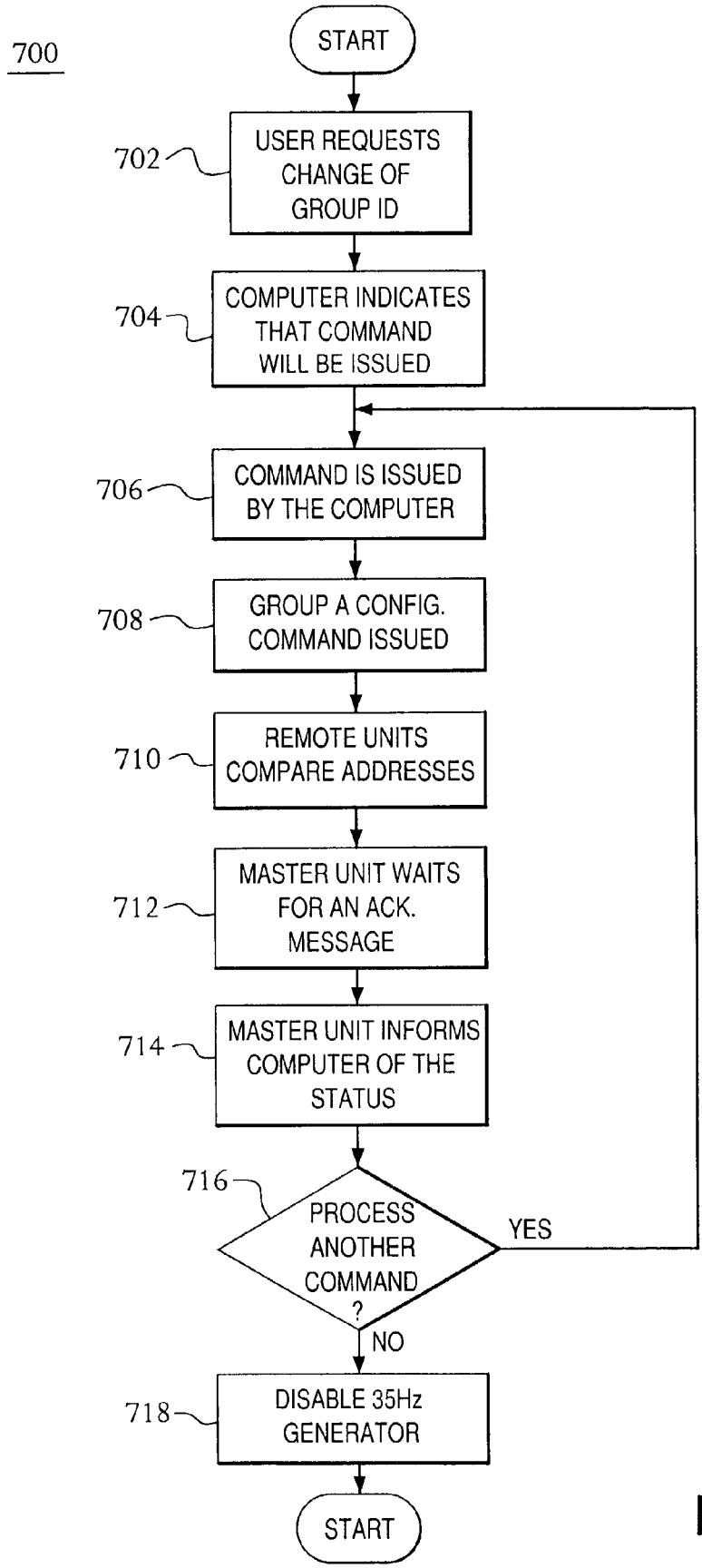
FIG. 7 is a flow chart depicting a sequence of operations for changing a group identifier (ID) and/or a tap setting from a computer in accordance with an embodiment of the present invention.

FIG. 7 is a flow chart depicting a sequence of operations for changing a group ID and/or a tap setting from a computer (e.g., computer 154 or a field programming device) in accordance with an embodiment of the present invention. The method 700 is initiated at step 702 where a user requests the change of a group ID or tap setting for a specific speaker(s) 152.

At step 704, the computer 154 communicates to the master control unit(s) 102 that a speaker command is about to be communicated. In response, the master control unit(s) 102 enable their respective 35 Hz generator/mixers 122 to power the remote units 130 and sends a confirmation to the computer 154 that the remote units 130 associated with the master control unit(s) 102 are powered and ready to receive the next command.

At step 706, the computer 154 communicates to the master control unit(s) 102 that a group configuration is required. For purposes of illustration, the Group A configuration is selected. The address of the remote units 130, group ID and desired tap settings are also communicated to the master control unit(s) 102.

At step 708, the master control unit(s) 102 communicate a Group A Configure command, along with the remote unit's 130 addresses, group ID and tap setting to their respective remote units 130.

At step 710, the remote units 130 compare the received addresses to their assigned address. If there is a match, the received configuration will be saved and an acknowledgement message is communicated to their respective master control unit(s) 102. If there is no match, the remote units 130 will ignore the command and power off.

At step 712, the master control unit(s) 102 wait for an acknowledgement from their respective remote units 130. If the waiting period expires, the master control unit(s) 102 resends the command as many as three times before a fault is declared.

At step 714, when an acknowledgement message is received or has timed out after three attempts to communicate with the remote units 130, their respective master control unit(s) inform the computer 154 of the success or failure of the requested configuration.

At step 716, the computer 154 repeats steps 706 to 714 if necessary and communicates to the master control unit(s) 102 that no additional commands will be sent.

At step 718, the master control unit(s) 102 disable their respective 35 Hz generator/mixers 122 and send a confirmation to the computer 154.

Those skilled in the art can now appreciate from the foregoing description that the broad teachings of the present invention can be implemented in a variety of forms. Therefore, while this invention can be described in connection with particular examples thereof, the true scope of the invention should not be so limited since other modifications will become apparent to the skilled practitioner upon a study of the drawings, specification and the following claims.

What is claimed is:

1. A speaker control system, comprising:

a central station for selectively communicating at least one of a command and an information signal to a destination device, wherein said destination device is associated with a speaker;

a tone generator for generating an activation tone for supplying power to said destination device; and an amplifier colocated with said central station for amplifying said information signal and said activation tone, prior to being received by said destination device.

2. The speaker control system of claim 1, wherein said activation tone comprises an inaudible signal.

3. The speaker control system of claim 1, wherein said destination device is one of a plurality of destination devices, each of the plurality of destination devices being associated with a speaker.

4. The speaker control system of claim 3, wherein each of said plurality of destination devices comprises an individual address.

5. The speaker control system of claim 4, wherein selected ones of said plurality of destination devices correspond to a group and each of the destination devices that correspond to the group comprise a group address.

6. The speaker control system of claim 5, wherein upon said plurality of destination devices receiving said activation tone, each of said plurality of destination devices is powered and activated, while receiving said activation tone, said plurality of destination devices receive said command signal that comprises an individual address and/or group address, wherein each of the plurality of destination devices that comprise an individual address and/or group address that corresponds to the individual address and/or group address contained in the command signal remains active, and wherein each of the plurality of destination devices that does not comprise an individual address and/or group address that corresponds to the individual address and/or group address contained in the command signal deactivates.

7. The speaker control system of claim 4, wherein each one of said plurality of destination devices receives said information signal, wherein said information signal is one of a plurality of information signals.

8. The speaker control system of claim 3, wherein each of said plurality of destination devices adjusts a volume level of each speaker associated with said plurality of destination devices, in accordance with said command.

9. The speaker control system of claim 1, wherein said command signal comprises an audio level setting for use by said destination device.

10. The speaker control system of claim 1, wherein said amplifier is located remote from said destination device.

11. The speaker control system of claim 1, wherein said information signal comprises at least one of musical content and human speech content.

12. The speaker control system of claim 1, wherein said information signal is transmitted from said central station in a first signal format and processed into a second signal format prior to being received at said destination device.

13. The speaker control system of claim 1, wherein communication between said central station and said tone generator is via an RS-485 interface.

14. The speaker control system of claim 1, wherein said information signal amplified by said amplifier is an analog signal.

15. A method for providing centralized speaker control, comprising:

selectively communicating providing at least one of a command signal and an information signal from a central station to a destination device, wherein said destination device is associated with a speaker;

generating an activation tone using a tone generator for supplying power to said destination device; and amplifying said information signal and said activation tone, prior to being received by said destination device, using an amplifier colocated with said central station.

16. The method of claim 15, wherein said activation tone comprises an inaudible signal.

17. The method of claim 15, wherein said destination device is one of a plurality of destination devices, each of the plurality of destination devices being associated with a speaker.

18. The method of claim 17, wherein each of said plurality of destination devices comprises at least one of a group address and an individual address.

19. The method of claim 15, wherein said destination device is located remote from said amplifier.

20. The method of claim 15, further comprising: selectively powering and activating said destination device in response to said destination device receiving said activation tone, while said destination device is receiving said activation tone said destination device receives said command signal comprising an address, wherein said destination device remains active in response to said address being associated with an address of said destination device and said destination device deactivates in response to said address not being associated with an address of said destination device.

* * * * *